US010752859B2

(12) United States Patent
Worthington et al.

(10) Patent No.: US 10,752,859 B2
(45) Date of Patent: Aug. 25, 2020

(54) GREASE COMPOSITION

(71) Applicant: SHELL OIL COMPANY, Houston, TX (US)

(72) Inventors: Edward Alexander Worthington, Hamburg (DE); Alan Richard Wheatley, Ince Chester Cheshire (GB)

(73) Assignee: SHELL OIL COMPANY, Houston, TX (US)

( * ) Notice: Subject to any disclaimer, the term of this patent is extended or adjusted under 35 U.S.C. 154(b) by 0 days.

(21) Appl. No.: 15/548,130

(22) PCT Filed: Feb. 3, 2016

(86) PCT No.: PCT/EP2016/052302
§ 371 (c)(1),
(2) Date: Aug. 2, 2017

(87) PCT Pub. No.: WO2016/124653
PCT Pub. Date: Aug. 11, 2016

(65) Prior Publication Data

US 2018/0030367 A1 Feb. 1, 2018

(30) Foreign Application Priority Data

Feb. 6, 2015 (EP) ..... 15154212

(51) Int. Cl.

| | |
|---|---|
| ***C10M 169/00*** | (2006.01) |
| ***C10M 169/04*** | (2006.01) |
| ***C10M 141/12*** | (2006.01) |
| ***C10M 105/04*** | (2006.01) |
| ***C10M 105/06*** | (2006.01) |
| ***C10M 107/08*** | (2006.01) |
| ***C10M 117/02*** | (2006.01) |
| ***C10M 125/02*** | (2006.01) |
| ***C10M 125/10*** | (2006.01) |
| ***C10M 125/22*** | (2006.01) |

(52) U.S. Cl.

CPC ..... *C10M 169/00* (2013.01); *C10M 105/04* (2013.01); *C10M 105/06* (2013.01); *C10M 107/08* (2013.01); *C10M 117/02* (2013.01); *C10M 125/02* (2013.01); *C10M 125/10* (2013.01); *C10M 125/22* (2013.01); *C10M 141/12* (2013.01); *C10M 169/04* (2013.01); *C10M 2201/041* (2013.01); *C10M 2201/062* (2013.01); *C10M 2201/065* (2013.01); *C10M 2201/066* (2013.01); *C10M 2203/06* (2013.01); *C10M 2203/102* (2013.01); *C10M 2203/106* (2013.01); *C10M 2205/026* (2013.01); *C10M 2207/1256* (2013.01); *C10M 2207/1406* (2013.01); *C10M 2219/106* (2013.01); *C10N 2210/03* (2013.01); *C10N 2230/06* (2013.01); *C10N 2240/04* (2013.01); *C10N 2240/50* (2013.01); *C10N 2250/10* (2013.01)

(58) Field of Classification Search

CPC ..... C10M 2201/041; C10M 2201/062; C10M 2201/066; C10M 2201/065; C10M 2203/06; C10M 2203/102; C10M 2203/106; C10M 2205/026; C10M 2207/1256; C10N 2210/03; C10N 2230/06; C10N 2240/04; C10N 2250/10

See application file for complete search history.

(56) References Cited

U.S. PATENT DOCUMENTS

| | | | | |
|---|---|---|---|---|
| 3,839,209 | A * | 10/1974 | Hermann | C10M 7/00 508/123 |
| 3,843,528 | A | 10/1974 | Bailey et al. | |
| 3,991,156 | A * | 11/1976 | Ronzio | C01G 39/06 423/53 |
| 5,093,015 | A | 3/1992 | Oldiges | |
| 2011/0082060 | A1* | 4/2011 | Faci | C10M 169/06 508/161 |
| 2011/0124537 | A1* | 5/2011 | Kilthau | C10M 169/04 508/122 |
| 2012/0302472 | A1* | 11/2012 | Litters | C10M 135/10 508/122 |

FOREIGN PATENT DOCUMENTS

| | | | |
|---|---|---|---|
| EP | 0668342 | A1 | 8/1995 |
| EP | 0776959 | A2 | 6/1997 |
| EP | 1029029 | A1 | 8/2000 |
| EP | 2154229 | A2 | 2/2010 |
| WO | 9721788 | A1 | 6/1997 |
| WO | 9941332 | A1 | 8/1999 |
| WO | 0008115 | A1 | 2/2000 |
| WO | 0014179 | A1 | 3/2000 |
| WO | 0014183 | A1 | 3/2000 |
| WO | 0014187 | A2 | 3/2000 |
| WO | 0014188 | A2 | 3/2000 |
| WO | 0015736 | A2 | 3/2000 |
| WO | 0118156 | A1 | 3/2001 |
| WO | 0157166 | A1 | 8/2001 |
| WO | 2012080940 | A1 | 6/2012 |

OTHER PUBLICATIONS

International Search Report and Written Opinion received for PCT Patent Application No. PCT/EP2016/052302, dated Apr. 22, 2016, 8 pages.

(Continued)

*Primary Examiner* — Vishal V Vasisth

(57) ABSTRACT

A grease composition comprises a base oil and an aluminium complex soap thickener, with graphite, molybdenum di-sulphide, calcium carbonate and bismuth sulphide all included as additives. The composition exhibits advantageous load, wear and friction performance, especially in extreme pressure environments, and is particularly suitable for use on open gears.

16 Claims, No Drawings

(56) References Cited

OTHER PUBLICATIONS

American Petroleum Institute (API) Publication 1509, 15th Edition, Appendix E, Apr. 2002.

* cited by examiner

GREASE COMPOSITION

PRIORITY CLAIM

The present application is the National Stage (§ 371) of International Application No. PCT/EP2016/052302, filed Feb. 3, 2016, which claims priority from European Patent Application No. 15154212.3, filed Feb. 6, 2015 incorporated herein by reference.

TECHNICAL FIELD OF THE INVENTION

The present invention relates to a grease composition and more particularly to an aluminium complex grease composition for use in heavy duty, high temperature and extreme pressure (EP) conditions.

BACKGROUND OF THE INVENTION

Machinery parts that undergo sliding and/or rotating actions require lubrication in order to maintain opposing surfaces separate, minimize friction and provide a cooling effect. Lubricants may also assist in cleaning the working area, preventing corrosion and providing a means of hydromechanical energy transfer. Lubricating oils or greases therefore play an important role in prolonging machine life and extending the periods between maintenance.

Moreover, in recent years, along with the advances made in machine technology, materials technology and machining precision, fatigue failure and damage to materials has reduced significantly, so the lifespan of machinery is greatly influenced by the performance of the lubricating oil or grease. Thus, enhancing the lubricating properties of the grease, and solving the problems associated therewith, may make a significant contribution to the raising of the quality and reliability of machinery.

The particular use and performance characteristics of the machinery in which a grease is to be used will determine the desired properties of the grease. For example, in mining and quarrying applications, it is necessary to provide excellent wear protection and long bearing life in relation to slow-moving but heavily loaded bearings and linkages, operating at high temperatures and subject to shock loads. Often, mining and quarrying operations are carried out in extreme environments, such as in regions exposed to sustained sub-zero temperatures, which may have a prevailing wet or dry climate, or in desert-like regions, etc. All these factors have to be taken into account in providing a grease composition that will perform well under the various internal and external influences.

Particularly useful greases are based upon a combination of lubricating oil and a complex soap. Complex soaps are frequently used as grease thickeners and offer superior temperature resistance as compared to their simple soap counterparts. Typically, complex soaps are derived from at least two dissimilar fatty acids, usually a combination of a short chain fatty acid soap and a long chain fatty acid soap. Such soaps may be made by saponification of a metallic hydroxide with the particular fatty acid(s), often taking place in a portion of the lubricating base oil whilst the mixture is blended or otherwise agitated to initiate the reaction. Once the soap has been formed, the balance of the lubricating base oil can be added. One or more additives may be introduced, depending on the desired properties of the final grease composition.

Aluminium complex greases are especially useful being easy to pump at low temperatures and are known to have good reversibility properties, that is, they have the ability to revert to normal consistency after being heated and cooled repeatedly. Another benefit of aluminium complex greases is their superior water-resistance, both in terms of resistance to washing out of a bearing and being washed off a substantially flat surface.

Particular challenges exist when lubricating open gear machinery that is subject not only to extreme ambient temperatures, but also extreme operating conditions. Thus aluminium complex greases are required to be modified by incorporation of one or more additives in order to provide a desired balance of properties for use in such machinery.

Accordingly, it is an object of the present invention to provide an improved aluminium complex grease composition for use in open gear machinery, such as in excavators and shovels used in the mining industry, especially to address the aforementioned challenges of creating a grease composition that performs to a high level under extreme pressure, displaying the requisite balance of wear and weld load properties.

SUMMARY OF THE INVENTION

From a first aspect, the invention resides in a grease composition for open gear use comprising a base oil and an aluminium complex soap thickener, wherein the composition further includes as additives graphite, molybdenum disulphide, calcium carbonate and bismuth sulphide.

By means of the present invention, the grease composition provides improved properties when used on highly loaded open gears. More specifically, and surprisingly, it has been found according to the present invention that lubricating compositions containing a combination of bismuth sulphide as well as molybdenum disulphide, together with a combination of graphite and calcium carbonate, exhibit an unexpected improvement in high load and anti-wear properties in open gear machinery as measured by the four-ball tests according to ASTM D2596 and DIN 51350-5E.

In particular, the grease composition according to the present invention demonstrates an improved balance of load, wear and friction performance as compared to compositions involving single additives or other combinations.

The beneficial anti-wear effects when used on open gear equipment therefore helps to reduce the frequency of replacing the gears, and therefore also results in less down-time for the equipment.

DETAILED DESCRIPTION OF THE INVENTION

The grease composition of the present invention contains a base oil, an aluminium complex soap thickening agent, and as additives graphite, molybdenum disulphide, calcium carbonate and bismuth sulphide as essential constituent components.

Preferably, the composition according to the invention includes graphite in an amount of from 1 to 15 wt. %, more preferably from 3 to 12 wt. %, most preferably from about 5 to 10 wt. %, based upon the total weight of the grease composition. The graphite may be natural graphite or synthetic graphite, preferably in powder form. For example, a preferred source of graphite has a density of about 2.2 g/ml, and a particle size D50 of 5 μm and D90 of 15 μm, such as that available from Branwell Graphite Ltd, under CAS No. 7782-42-5.

Calcium carbonate used in the composition of the invention is preferably included in an amount of from 1 to 15 wt.

%, more preferably from 3 to 12 wt. %, most preferably from about 5 to 10 wt. %, based upon the total weight of the grease composition. Calcium carbonate is preferably used in powder form, and may be natural (as ground calcium carbonate) or synthetic (as precipitated calcium carbonate). Of the various calcium carbonate polymorphs, calcite is especially preferred for use in the composition of the present invention. A preferred source of calcium carbonate has a density of about 2.7 g/ml, and a particle size D50 of 1 μm and D90 of 8 μm, such as that available under trade name Hydrocarb OG from Omya AG, under CAS No. 471-34-1.

Molybdenum disulphide used in the composition of the invention is preferably included in an amount of from 1 to 15 wt. %, more preferably from 3 to 12 wt. %, most preferably from about 5 to 10 wt. %, based upon the total weight of the grease composition. Molybdenum disulphide is preferably used in powder form, ideally of >98% purity grade, and may, for example, be derived from the decomposition of ammonium thiomolybdate (ATM) or from refining the mineral molybdenite. A preferred source of molybdenum disulphide has a density of about 4.9 g/ml, and a particle size D50 of 5 μm and D90 of 10 μm, such as that supplied by Climax Molybdenum Co., under CAS No. 1317-33-5.

Bismuth sulphide used in the composition of the invention is preferably included in an amount of from 0.1 to 15 wt. %, more preferably from 0.5 to 10 wt. %, most preferably from about 1 to 5 wt. %, based upon the total weight of the grease composition.

Bismuth sulphide is commercially available in several different forms, including forms based upon particle size. Bismuth sulphide is preferably used in powder form and may be derived from natural sources (such as from bismuthinite) or produced synthetically.

Bismuth sulphide having a particle size D50 of 10 μm and D90 of 40 μm, such as that supplied under the trade name Tribotecc BIS 83 by Tribotecc GmbH, under CAS No. 1345-07-9 has been found to be especially suitable. The bismuth sulphide preferably has a density of about 6.9 g/ml.

The bismuth sulphide preferably has a particle size at least about 50% greater than the particle sizes of the graphite, calcium carbonate and molybdenum disulphide additives. For example, the bismuth sulphide may have a particle size D50 of 10 μm or greater and/or D90 of 40 μm or greater, and the graphite, calcium carbonate and molybdenum disulphide preferably have particle sizes D50 of 5 μm or less and/or D90 of 15 μm or less.

There are no particular limitations regarding the base oil composition used in the present invention, and various conventional mineral oils and synthetic oils may be conveniently used. The base oil composition used in the present invention may comprise mixtures of one or more mineral oils and/or one or more synthetic oils.

Mineral oils for use in the grease composition of the present invention include any of the Group I, Group II and Group III base oils. By "Group I" base oil, "Group II" base oil and "Group III" base oil are meant lubricating oil base oils according to the definitions of American Petroleum Institute (API) categories I, II and III. Such API categories are defined in API Publication 1509, 15th Edition, Appendix E, April 2002.

Particularly suitable mineral oils for use in the present invention include liquid petroleum oils and solvent-treated or acid-treated mineral lubricating oils of the paraffinic, naphthenic, or mixed paraffinic/naphthenic type which may be further refined by hydrofinishing processes and/or dewaxing.

Other suitable mineral oils that may conveniently be used as the base oil or a component thereof in the grease composition of the present invention include Fischer-Tropsch derived base oils, such as those disclosed for example in EP 0 776 959, EP 0 668 342, WO 97/21788, WO 00/15736, WO 00/14188, WO 00/14187, WO 00/14183, WO 00/14179, WO 00/08115, WO 99/41332, EP 1 029 029, WO 01/18156 and WO 01/57166.

Synthetic oils that may be used in the grease compositions of the present invention include Group IV base oils, especially hydrocarbon oils such as olefin oligomers (PAOs), and Group V base oils, such as dibasic acid esters, polyol esters, dewaxed waxy raffinate and polybutenes. Synthetic hydrocarbon base oils sold by the Shell Group under the designation "XHVI" (trade mark) may be conveniently used.

The total amount of base oil incorporated in the lubricating composition of the present invention is preferably in the range of from 30 to 95 wt. %, more preferably in an amount in the range of from 45 to 90 wt. % and most preferably in an amount in the range of from 60 to 85 wt. %, with respect to the total weight of the lubricating composition. All percentages herein defined are expressed with reference to the total weight of the lubricating composition.

Preferably the grease composition of the invention has a minimum base oil viscosity of 3,600 cSt at 40° C. Such a viscosity is enables extreme pressure use and provides excellent adhesiveness, film and coverage, and facilitates application by pump or spray means.

In a preferred composition of the present invention, the base oil comprises polybutene as a substantial component thereof, ideally as the major component of the base oil. For example, polybutene is preferably included in an amount of 20 wt % to 50 wt. %, more preferably in an amount of 30 wt. % to 45 wt. %, and most preferably in an amount of 35 to 40 wt % based upon the total weight of the grease composition. A preferred polybutene for use in the composition of the present invention has a density in the region of 0.9 g/ml, such as that supplied by INEOS, under CAS No. 9003-29-6.

The base oil of the grease composition of the present invention preferably also comprises a paraffinic base oil, preferably in an amount of 10 wt. % to 40 wt. %, more preferably in an amount of 15 wt. % to 30 wt. %, and most preferably in an amount of 20 wt. % to 25 wt % based upon the total weight of the grease composition. An example of a paraffinic base oil for use in the composition is a solvent-dewaxed, heavy paraffinic petroleum distillate oil, such as that supplied by Shell, under CAS No. 64742-65-0.

Other distillate base oils may be included in the composition including, for example, hydrotreated, heavy naphthenic distillate oil, one example of which being that supplied by Nynas, under CAS No. 64742-52-5. When present, the latter is generally included in lower amounts as compared with the heavy paraffinic distillate oil, preferably in an amount of 5 wt % or less based upon the total weight of the composition, and most preferably in an amount of 1 wt % or less.

Advantageously, the base oil may further comprise a naphthenic base oil, especially in an amount in the range of from 1 to 15 wt. %, more preferably in an amount of 5 wt % to 10 wt % based on the total weight of the composition. An example of a naphthenic oil for use in the grease composition of the invention is that supplied by Shell, under CAS No. 64742-52-5.

The aluminium complex soap thickener included in the composition according to the invention is preferably added in an amount of from 0.5 wt. % to 15 wt. %, more preferably from 1 wt. % to 10 wt. %, and most preferably from 2 wt.

% to 8 wt. % based upon the total weight of the grease composition. Preferably the complex soap is formed in situ by addition of the dissimilar acids and the aluminium source to the base oil, or to a portion of the base oil or to a base oil component.

The thickener is preferably formed from a long chain aliphatic acid having 12-25 carbon atoms, such as stearic acid, palmitic acid, linoleic acid and tall oil acids, and an aromatic carboxylic acid having 10 or fewer carbon atoms, such as benzoic acid, toluic acid and ethylbenzoic acid. A particularly preferred aluminium complex soap thickener for use in the invention is one derived from stearic acid and benzoic acid. For example, such a thickener may be derived from aluminium acylate, stearic acid and benzoic acid.

Other conventional additives may be included in the grease composition of the invention, preferably in amounts of 5 wt. % or less. Such conventional additives may, for example, include but are not limited to corrosion inhibitors, metal deactivators, detergents, anti-foaming agents, polymers, colourants, and water repellency agents.

Use of dimercaptothiadiazole or derivatives thereof as a corrosion inhibitor is especially preferred.

The grease composition of the present aspect may be produced using commonly known grease production methods. For example, the base oil(s) and fatty acid components may be added to a grease production tank, followed by addition of the aluminium salt, whereupon saponification occurs to generate the complex soap in the base oil. Heating may be used to ensure all components are melted and thereafter to dehydrate the composition. Blending is effected through vigorous stirring and the mixture allowed to return to room temperature. The additives may be introduced at the same time as the thickening components, or following saponification. Homogenization of the resulting grease composition may be required and, if so, is typically performed using a roll mixer, such as a three-roll mill.

EXAMPLES

The present invention will now be described with reference to the following example, but is not limited thereto.

A grease composition according to the present invention is prepared by blending the following, all amounts expressed at wt. % based upon the total weight of the composition:

| | |
|---|---|
| Thickener | |
| Aluminium acylate | 4.0 |
| Stearic acid | 1.0 |
| Benzoic acid | 0.5 |
| Base Oil | |
| Paraffinic base oil | 22.0 |
| Naphthenic base oil | 9.0 |
| Alkyl benzenes | 2.3 |
| Polybutene | 38.0 |
| Hydrotreated heavy naphthenic distillate | 0.8 |
| Additives | |
| Bismuth sulphide | 1.0 |
| Graphite | 5.0 |
| Calcium carbonate | 5.0 |
| molybdenum disulphide | 5.0 |
| Other Additives | |
| Mining additive package | 4.5 |
| Dimercaptothiadiazole derivative | 1.9 |
| | 100.0 |

Field trials involving use of a grease composition in accordance with the present invention were carried out at Shell Albian Sands, Canada, by installing the composition on the hoist gearing system of an electric rope shovel (a CAT 7495 HF shovel). Periodic inspections and temperature readings were taken over a period of six months (approx. 4,000 hours), as production permitted. A gear inspection conducted five months into the trial indicated that no plastic deformation had occurred nor were any wear patterns observed. Grease coverage and performance were considered exceptional.

That which is claimed is:

1. A grease composition comprising from 30 to 90 wt. % of a base oil, based upon the total weight of the grease composition; and an aluminum complex soap as a thickening agent, and wherein the aluminum complex soap comprises at least a long chain aliphatic acid having 12-25 carbon atoms and an aromatic carboxylic acid having 10 or fewer carbon atoms;

wherein the composition further includes as additives (i) from 1 to 15 wt. % graphite based upon the total weight of the grease composition, (ii) from 1 to 15 wt. % molybdenum disulphide of a 98% or greater purity based upon the total weight of the grease composition, (iii) from 1 to 15 wt. % calcium carbonate based upon the total weight of the grease composition and (iv) from 0.1 to 15 wt. % bismuth sulphide based upon the total weight of the grease composition; and wherein the base oil comprises polybutene in an amount of from 20 wt. % to 50 wt. %, based upon the total weight of the grease composition.

2. The grease composition according to claim 1, wherein bismuth sulphide has a particle size D50 of 10 μm or greater and D90 of 40 μm or greater.

3. The grease composition according to claim 2, wherein the bismuth sulphide has at least about a 50% greater than particle size than the particle sizes of graphite, calcium carbonate and molybdenum disulphide, wherein the graphite, calcium carbonate and molybdenum disulphide each have a particle size D50 of 5 μm or less and/or D90 of 15 μm or less.

4. The grease composition according to claim 1, wherein the base oil comprises a blend of polybutene, a paraffinic base oil and a naphthenic base oil.

5. The grease composition according to claim 1, comprising aluminum complex soap thickener in an amount of from 0.5 wt. % to 15 wt. %, based upon the total weight of the grease composition.

6. The grease composition according to claim 1, comprising graphite in an amount of from 3 to 12 wt. %, based upon the total weight of the grease composition.

7. The grease composition according to claim 1, comprising graphite in an amount of from 5 to 10 wt. %, based upon the total weight of the grease composition.

8. The grease composition according to claim 1, comprising molybdenum disulphide in an amount of from 3 to 12 wt. %, based upon the total weight of the grease composition.

9. The grease composition according to claim 1, comprising molybdenum disulphide in an amount of from 5 to 10 wt. %, based upon the total weight of the grease composition.

10. The grease composition according to claim 1, comprising calcium carbonate in an amount of from 3 to 12 wt. %, based upon the total weight of the grease composition.

11. The grease composition according to claim 1, comprising calcium carbonate in an amount of from 5 to 10 wt. %, based upon the total weight of the grease composition.

12. The grease composition according to claim 1, comprising bismuth sulphide in an amount of from 3 to 12 wt. %, based upon the total weight of the grease composition.

13. The grease composition according to claim 1, comprising bismuth sulphide in an amount of from 5 to 10 wt. %, based upon the total weight of the grease composition.

14. The grease composition according to claim 1, comprising aluminum complex soap thickener in an amount of from 1 wt. % to 10 wt. %, based upon the total weight of the grease composition.

15. The grease composition according to claim 1, comprising aluminum complex soap thickener in an amount of from 2 wt. % to 8 wt. %, based upon the total weight of the grease composition.

16. The grease composition according to claim 1, wherein the aluminum complex soap is derived from aluminum acylate, stearic acid, and benzoic acid.

* * * * *